US007234505B2

(12) United States Patent
Murray et al.

(10) Patent No.: US 7,234,505 B2
(45) Date of Patent: Jun. 26, 2007

(54) ALUMINIUM PRESSURE CASTING

(75) Inventors: Morris Taylor Murray, Briar Hill (AU); Matthew Alan Cope, Somerville (AU)

(73) Assignee: Commonwealth Scientific and Industrial Research Organisation, Campbell, ACT (AU)

( * ) Notice: Subject to any disclaimer, the term of this patent is extended or adjusted under 35 U.S.C. 154(b) by 0 days.

(21) Appl. No.: 10/369,561

(22) Filed: Feb. 21, 2003

(65) Prior Publication Data

US 2003/0173052 A1 Sep. 18, 2003

Related U.S. Application Data

(63) Continuation of application No. PCT/AU01/01058, filed on Aug. 24, 2001.

(30) Foreign Application Priority Data

Aug. 25, 2000 (AU) ..... PQ9678

(51) Int. Cl.
*B22D 17/00* (2006.01)

(52) U.S. Cl. ..... 164/113; 164/120; 164/133; 164/900

(58) Field of Classification Search ..... 164/113, 164/120, 133, 900, 312, 337
See application file for complete search history.

(56) References Cited

U.S. PATENT DOCUMENTS 2,735,147 A * 2/1956 Friedrich ..... 249/205
2,763,905 A * 9/1956 Friedrich ..... 249/205

(Continued)

FOREIGN PATENT DOCUMENTS

DE 4 312 175 A 10/1994
DE 196 19 882 A1 11/1997
EP 0 005 239 A1 11/1979

(Continued)

OTHER PUBLICATIONS

International search report of PCT/AU01/01058, Australian Patent Office, Oct. 4, 2001.*
ASM Handbook, Volume 15 Casting, The Materials Information Society, USA, 1988, pp. 286–295, 327–338.
JP358125356A, "Injecting Method of Die Casting Machine" Jul. 26, 1983, Takahiko et al.

(Continued)

*Primary Examiner*—Kevin Kerns
*Assistant Examiner*—I. H Lin
(74) *Attorney, Agent, or Firm*—John C. Kerins

(57) ABSTRACT

A metal flow system, for use in casting aluminium alloy using a pressure casting machine, is provided by a component of a die or mould assembly, for the machine, which defines a die cavity. The component defines at least part of an alloy flow path for the flow of aluminium alloy from a pressurized source of substantially molten aluminium alloy of the machine to the die cavity. The flow path includes at least one runner and a controlled expansion port, referred to also as a CEP, which has an inlet through which the CEP is able to receive aluminium alloy from the runner and an outlet through which aluminium alloy is able to flow from the CEP for filling the die cavity. The CEP increases in cross-sectional area from the inlet to the outlet thereof to cause substantially molten alloy received into the runner to undergo a substantial reduction in flow velocity in its flow through the CEP whereby the aluminium alloy flowing through the CEP attains a viscous or semi-viscous state which is retained in filling the die cavity. A pressure casting machine includes the metal flow system, while the system also is used in a process for pressure casting of aluminium alloys.

16 Claims, 8 Drawing Sheets

U.S. PATENT DOCUMENTS

| | | | | | |
|---|---|---|---|---|---|
| 4,415,374 | A | * | 11/1983 | Young et al. | 148/550 |
| 4,986,338 | A | | 1/1991 | Yamauchi et al. | |
| 5,040,589 | A | * | 8/1991 | Bradley et al. | 164/113 |
| 5,076,344 | A | | 12/1991 | Fields et al. | |
| 5,211,216 | A | | 5/1993 | Drury et al. | |
| 5,263,531 | A | | 11/1993 | Drury et al. | |
| 5,361,826 | A | | 11/1994 | Yamauchi et al. | |
| 5,394,931 | A | | 3/1995 | Shiina et al. | |
| 5,685,357 | A | | 11/1997 | Kato et al. | |
| 5,697,422 | A | | 12/1997 | Righi et al. | |
| 5,979,535 | A | | 11/1999 | Sakamoto et al. | |
| 6,001,296 | A | * | 12/1999 | Rodenburgh et al. | 264/328.12 |
| 6,436,320 | B1 | * | 8/2002 | Kazmer et al. | 264/40.1 |
| 6,619,370 | B2 | * | 9/2003 | Sakamoto et al. | 164/113 |
| 6,634,412 | B1 | * | 10/2003 | Murray et al. | 164/113 |

FOREIGN PATENT DOCUMENTS

| | | | | |
|---|---|---|---|---|
| EP | 701 002 | A1 | | 4/1996 |
| EP | 799 901 | A1 | | 10/1997 |
| EP | 968782 | | | 1/2000 |
| EP | 0968782 | | * | 1/2000 |
| EP | 968 782 | A2 | | 5/2000 |
| WO | 97/06907 | | | 2/1997 |
| WO | 97/30806 | | | 8/1997 |
| WO | 99/28065 | | * | 6/1999 |
| WO | WO 99/28065 | | | 6/1999 |

OTHER PUBLICATIONS

JP 59–097749, May 06, 1984, "Casting Method of Die Casting Product", Nakamura Motoshi et al.

JP 09253821 A, Sep. 30, 1997, "Die–cast casting –where a molten metal in a sleeve is injected in a die through a gate and a rubber by using an injection plunger to obtain a cast material", Honda Motor Co. Ltd.

User Manual "Metlflow" vol. 1 : Design Concept, M.A. Cope and T. H. Siauw, Apr. 1985.

Zinc Pressure die casting –the metal flow system, MA Cope Australian Zinc Development Association.

Sully, Lionel J.D., "Die Casting", ASM Handbook, vol. 15, pp. 286–287.

Rice, Chris S. et al., "Slurry–Based Semi–Solid Die Casting", Advanced Materials and Processing, Oct. 2001, pp. 49–52.

Mihelich, Dr. John L., "Semi–Solid Metal Casting", ASM–Atlanta Newsletter, Feb. 2002, pp. 5–7.

Kenney, Micheal P. et al., "Semisolid Metal Casting and Forging", ASM Handbook, vol. 15, pp. 327–338.

Shawki et al., A Review of Design Parameters and Machine Performance for Improved Die Casting Quality, J. Machanical Working Technology, vol. 16, No. 3, pp. 315–333, Jun. 1988.

* cited by examiner

ALUMINIUM PRESSURE CASTING

CROSS REFERENCE TO RELATED APPLICATIONS

This application is a continuation of PCT application No. PCT/AU01/01058, filed Aug. 24, 2001, and published under PCT Article 21(2) in the English language on Feb. 28, 2002, as WO 02/16062 A1.

BACKGROUND OF THE INVENTION

1. Field of the Invention

This invention relates to an improved metal flow system or runner/gate arrangement, for use in the production of pressure castings made from aluminium alloys, such as but not exclusively in a molten or thixotropic state, suitable for use with various forms of pressure casting machines including, but not limited to, existing hot and cold chamber die casting machines.

2. Description of Related Art

An understanding has developed throughout the international pressure casting industry that it is necessary to use large runners to prevent premature freezing of the molten aluminium alloy metal during pressure casting. Within the industry, there are many different design methods which are thought to provide satisfactory castings from aluminium alloys. However, common to these different methods is a reliance on runner systems of large volume relative to casting size and low metal flow velocities through the runners.

To illustrate the large volume runner systems used by current systems in pressure casting of aluminium alloys, it is usual for a foundry having an annual casting production level of 250,000 tonnes of saleable castings to have processed some 450,000 tonnes of alloy, where the weight of sprue/runner metal of alloy is about 200,000 tonnes. In this production, it is usual to use oversized runners, in order to prevent alloy freeze-up, with the result that runner velocities of about 10 $m.sec^{-1}$ are achieved. Corresponding gate velocities are about 30–45 $m.sec^{-1}$, with the gate velocity more usually being in the range of 30–35 $m.sec^{-1}$. Of the aggregate quantity of melt poured, only about 55% results in productive output. As a consequence, there is a need for an excessive inventory of aluminium alloy required to allow for the remaining metal consumed as runner metal to be recycled. There accordingly is a high level of excess energy consumption in heating alloy which, after casting, needs to be recovered and recycled. Also, it is typical for there to be alloy loss at a level of about 3% of the total tonnage poured which, on the indicated level of foundry output, represents a loss of about 13,500 tonnes (at a cost of about AU$30M).

In such production, there are significant costs additional to the high level of aluminium alloy inventory, the loss of alloy and the cost of heating, recovery and recycling runner/gate alloy. At the level of output indicated, there may be five furnaces required for preparation of molten alloy for casting. Such furnaces can cost about AU$15M each, and reducing the number of these furnaces by only one, along with its ancillary equipment, would achieve a substantial saving in capital expenditure. Also, casting die costs can amount to about 15% of overall production cost, and an improvement in die life would provide substantial scope for further savings. Indeed, the overall cost burden is such that it serves to highlight how entrenched is the thinking on established foundry practice on pressure casting of aluminium alloys.

We have found that, by use of the present invention, it is possible and practical to produce high quality pressure castings of aluminium alloys of at least comparable quality to those provided by established foundry practice, but with substantial cost savings. The nature of the cost savings are detailed later herein.

SUMMARY OF THE INVENTION

The present invention provides or uses, for the pressure casting of aluminium alloy in a pressure casting machine having a mould or die which defines a die cavity, a metal flow system through which aluminium alloy is able to flow along a metal flow path into the die cavity. The metal flow system according to the present invention has an arrangement which defines at least part of the flow path and which includes at least one runner and what is referred to herein as a controlled expansion port or point (CEP).

Thus, according to the invention, there is provided a metal flow system, for use in casting aluminium alloy using a pressure casting machine, wherein the metal flow system is provided by a component of a die or mould assembly for the machine, the die or mould assembly defines a die cavity and the component defines at least part of an alloy flow path for the flow of aluminium alloy from a pressurised source of substantially molten aluminium alloy of the machine to the die cavity, the flow path includes at least one runner and a controlled expansion port (herein referred to as a "CEP") which has an inlet through which the CEP is able to receive aluminium alloy from the runner and an outlet through which aluminium alloy is able to flow from the CEP for filling the die cavity, and wherein the CEP increases in cross-sectional area from the inlet to the outlet thereof to cause substantially molten alloy received into the runner to undergo a substantial reduction in flow velocity in its flow through the CEP whereby the aluminium alloy flowing through the CEP attains a viscous or semi-viscous state which is retained in filling the die cavity.

The invention also provides a pressure casting machine, for use in casting aluminium alloy using a pressure casting machine, wherein the machine includes a metal flow system provided by a component of a die or mould assembly for the machine, the die or mould assembly defines a die cavity and the component defines at least part of an alloy flow path for the flow of aluminium alloy from a pressurised source of substantially molten aluminium alloy of the machine to the die cavity, the flow path includes at least one runner and a controlled expansion port (herein referred to as a "CEP") which has an inlet through which the CEP is able to receive aluminium alloy from the runner and an outlet through which aluminium alloy is able to flow from the CEP for filling the die cavity, and wherein the CEP increases in cross-sectional area from the inlet to the outlet thereof to cause substantially molten alloy received into the runner to undergo a substantial reduction in flow velocity in its flow through the CEP whereby the aluminium alloy flowing through the CEP attains a viscous or semi-viscous state which is retained in filling the die cavity.

Additionally, the invention provides a process for producing castings of an aluminium alloy, using a pressure casting machine having a pressurised source of substantially molten aluminium alloy and a die or mould assembly defining a die cavity, wherein the process includes the steps of causing the alloy to flow from the source to the die cavity along an alloy flow path defined by a component of the die or mould assembly; causing the alloy, in its flow along the flow system, to flow through a runner and through an inlet end of a controlled expansion port (herein referred to as a "CEP"); and causing the alloy, in its flow through the CEP to an outlet end of the CEP, to decrease in flow velocity, whereby the alloy is caused to attain a sufficient flow velocity at the inlet of the CEP, and to undergo a substantial reduction in that flow velocity in its flow through the CEP, such that the alloy attains a viscous or semi-viscous state and retains that state in filling the die cavity.

The controlled expansion port (CEP) has an inlet end or entry from the runner and an outlet end or exit from which alloy flows to or into the die cavity. The entry into the CEP from the runner may be of the same cross-sectional area, but preferably is smaller than the runner. However, the outlet end of the CEP or exit into the cavity has a larger cross-sectional area than the CEP inlet so as to achieve a substantially lower metal velocity than that at the inlet end of or entry to the CEP. Over the length of the CEP between its entry to the CEP and its exit the cross-sectional area of the CEP increases so that the flow velocity of alloy therethrough decreases, while the CEP is preferably tapered from the inlet to its exit.

The outlet end or exit of the CEP may, and preferably does, define an inlet to the die cavity. However, in an alternative arrangement, the runner of the metal flow system may terminate at or adjacent to an inlet to the die cavity. In that alternative arrangement, the metal flow system may include a portion of the die cavity at or adjacent to the runner outlet, with that die cavity portion defining at least part of the extent of a CEP from the outlet towards the inlet of the CEP. However, in a further alternative arrangement, the CEP may be intermediate the ends of respective runners. The first runner is upstream of the CEP in the alloy flow direction, and a second runner is downstream of the CEP in that direction. That is, the first runner provides alloy flow to the inlet of the CEP and the second runner provides alloy flow from the exit of the CEP to the die cavity. In that further alternative, the second runner preferably has a cross-section which is not less than that of the CEP outlet end.

The metal flow system may be of a form providing for control of metal flow velocities through the runner and CEP whereby at least a substantial proportion of the aluminium alloy flowing through the die cavity is in a viscous or semi-viscous state. For this purpose, the arrangement preferably is such that the aluminium alloy metal flow velocity through the inlet end of the CEP is in excess of 40 m/s, preferably in excess of 50 m/s, such as from 80 to 110 m/s. The flow velocity at the outlet end of the CEP generally is from about 50 to about 80%, preferably from 65 to 75% of the inlet end velocity. The outlet end velocity may be in excess of 20 m/s, preferably in excess of 30 m/s, such as from 40 to 95 m/s, and most preferably from about 40 to 90 m/s. These velocities are much greater than the values of the current systems.

In addition to the increased alloy flow velocity through the runner and CEP able to be provided in the system according to the invention, it will be noted that the alloy flow velocity through the inlet of the CEP exceeds that of the CEP outlet end or exit flow velocity. This is the converse to the situation obtaining with the runner and gate arrangements of the current systems, and results from a difference in the cross-sectional area relationship between the respective arrangements. Thus, while the known systems utilise a gate of lesser cross-sectional area than the corresponding runner, the present invention can have a CEP exit which is of greater cross-sectional area than the corresponding runner cross-section upstream of the CEP. In the former case, metal flow is constricted and increases in velocity through the gate relative to the runner while the converse is able to be achieved in the system of the invention.

In such runner/CEP arrangement according to the invention, the CEP can be defined by a terminal portion at the die cavity end of the runner. That terminal portion can be relatively short in the direction of aluminium alloy metal flow, such as up to about 5 mm in length. However, in most instances, a CEP may be much longer, depending on the size of the casting to be made. Thus, a CEP may have a length up to at least 40 mm, but it generally is up to about 20 mm, for example 10 to 15 mm, in length. However, in an alternative arrangement, the cross-sectional area of the runner can be maintained up to the die cavity, with the required CEP being provided by the shape of a portion of the die cavity. That is, there may simply be a runner, with no gate in the conventional sense; but rather a notional CEP defined within the die cavity by the mould or die. However, as indicated above, the flow path may have a first runner from which alloy flows into the CEP, and a second runner to which alloy flows from the CEP to the die cavity. In such two-part runner arrangement, the second runner preferably has a cross-sectional area which is not less, and most preferably is larger, than the cross-sectional area of the outlet end of the CEP and, hence, does not provide a constriction to flow of alloy from the CEP to the die cavity.

Where the CEP opens to, or is defined by a portion of the die cavity, the system of the invention enables the production of castings by direct injection of alloy to the die casting. However, where the CEP is between respective runners, the invention enables indirect injection. In each case, the system may have more than one flow path each having a respective runner/CEP arrangement, with each runner and its CEP providing for the supply of alloy to a common die cavity or to a respective die cavity. Particularly in the latter case, where each CEP is between respective first and second runners as discussed above, at least each second runner which provides for alloy flow beyond the outlet end of its CEP may extend laterally from a direction of alloy flow into the system. Thus, at least each second runner may be defined along a parting plane between two die tool parts which define each die cavity.

According to the present invention, where an actual CEP is provided by a terminal end portion at the die cavity end of the runner, it can be a simple enlargement which tapers to increase in cross-section beyond the runner. The actual CEP preferably is of round or rectangular cross-section. A channel defining a runner providing alloy flow to the inlet of a CEP, that is, a first runner, can be linear. However, it is preferred that the channel has severe changes of direction to encourage turbulence in the flow of aluminium alloy to the CEP. Thus, the runner channel may be a dog-leg form in having at least two portions which are mutually inclined. Indeed, some of the better results obtained, in use of the system according to the invention, have utilised a runner in which an upstream runner portion extends a short distance beyond its junction with a downstream portion, to define a blind end of the upstream portion.

The use of a runner giving rise to turbulence in aluminium alloy metal flow therethrough is in contrast to practice in the current systems. That is, the runners and gates of the current systems are designed to minimise turbulence therein and, hence, within the die cavity, thereby achieving flow which approximates to laminar flow or which is as smooth as possible.

At least for larger aluminium alloy castings, it is current practice, to utilise a chisel, fangate or tapered tangential runner, or oppositely extending twin tapered tangential runners. Such runners need to be carefully designed in order to achieve a smooth flow of aluminium alloy metal from the shot sleeve to the gate in each runner and to ensure flow along the length of each runner. As indicated, these and other runners used in current practice are oversized in order to avoid molten metal from freezing and, as a result, they give rise to the relatively low runner and gate flow velocities. However, due to the runners being oversized and necessitating a correspondingly large piston/shot sleeve to feed molten alloy to them, the volume and hence weight of solidified biscuit (slug) and runner metal is substantial relative to the casting volume and weight.

The aluminium alloy metal flow system of the present invention obviates the need for such complex and relatively large runner systems, and enables the runner metal to be small relative to the current systems. That is, the ratio of runner metal weight to aluminium alloy product weight with use of the present invention is substantially better than with use of current systems. Thus, the inventory of aluminium alloy required can be substantially reduced, as can the energy level in melting alloy which, after casting, needs to be recovered and recycled. Also, while the percentage loss of alloy during remelt/holding is about the same as with current systems (3%), the invention is able to result in the tonnage poured being substantially reduced, and the tonnage of alloy lost therefore is correspondingly reduced. Additionally, the runner, of the metal flow system of the invention, can be relatively short, further reducing the quantity of runner metal.

Prior practices generally have resulted in a weight of runner/sprue metal which solidifies with a casting, and needs to be separated and recycled, which is in excess of 50% of the casting weight and over 100% in some cases. In contrast, the metal flow system of the invention enables the weight of runner/CEP metal which is less than 30% of the casting weight, in some instances down to about 15% to 20%. This, of course, is a significant practical benefit, since the cost of recovering and re-processing of recycled metal is correspondingly reduced. Also, the present invention generally obviates the need for die cavity overflows, unless these are required to facilitate ejection of a casting from the die.

The higher runner/CEP metal velocities preferably used in the present invention are a major factor in achieving these savings. However these velocities do not necessitate larger and, hence, more expensive pressure casting machines than are used with current systems. Rather, the velocities are obtainable with the same casting machines as used in casting aluminium alloys with current systems, and are enabled by use of metal flow systems of substantially reduced cross-sectional areas compared to current systems. These reductions in cross-sectional area, combined with the simple form of the metal flow system of the present invention, are factors which enable the reduction in sprue/runner metal. However, there are inter-related factors which enable the reduction in runner metal to be further optimised.

Inter-related factors further enabling the ratio of sprue/runner metal to aluminium alloy casting weight to be reduced are that the metal flow system of the invention enables a high level of flexibility in choice of location of an inlet to a die cavity, in contrast to the limited choice with a gate in prior art practice, and the ability with the invention to produce sound castings using what effectively is a direct injection arrangement for the supply of alloy to the die cavity. As previously indicated, the runner/CEP arrangement can be of a form that is non-linear, such as a dog-leg or even cranked form. Rather than having, for example, a runner which has a long narrow gate extending therealong, as in the tangential runners of current systems, the metal flow system of the invention can, for example, have a terminal portion which extends directly towards and communicates with the die cavity, for example, substantially perpendicularly through a wall defining the die cavity. The location at which this communication is provided can be chosen from various suitable locations, with a principal determinant being the need to avoid die erosion at an adjacent surface of the die cavity. However, where a notional CEP is to be defined within the die cavity, the form and dimensions of the die cavity at such location need to be such as to allow for this, and avoidance of the erosion can therefore be a determinate of choice of communication location.

With use of the metal flow system of the present invention, temperature conditions may be similar to those used with current systems. Thus, the die may be operated at a temperature of from about 160° C. to about 220° C., while the aluminium alloy can be cast at a temperature of from about 610° C. to about 670° C., depending on the alloy concerned. Under such conditions, good aluminium alloy castings are able to be produced which are at least comparable in quality to those produced with current systems. Under such conditions, die cavity fill is achieved while the aluminium alloy is in a substantially semi-liquid state or thixotropic state.

In contrast to the temperature conditions used in practice with current systems, the metal flow system of the present invention also enables production of good aluminium alloy castings under temperature conditions in which die cavity fill is with the aluminium alloy in a substantially semi-solid or thixotropic state. Under these conditions die temperatures can be in the range of from about 60° C. to about 100° C., with alloy metal temperature around 610° C., depending on the alloy concerned. As will be appreciated, these conditions enable energy costs to be reduced, while the lower aluminium alloy casting temperature can assist in maintaining alloy compositional stability and in improving die longevity.

While casting is possible under temperature conditions intermediate the indicated two sets of conditions, use of conditions of one or other of those sets is highly preferred. In general, it can be difficult to maintain a consistently high casting output quality at intermediate conditions, although those conditions can be used for at least some forms of castings.

The metal flow system of the present invention can be used advantageously with the full range of conventional aluminium die casting alloys. However, at least under the lower temperature casting conditions detailed above, it is found that at least reasonable to good quality castings can be produced with aluminium alloys of some series which are not regarded as suitable casting alloys using current pressure casting systems. Examples of the latter alloys which may be able to be cast, using the metal flow system of the present invention, include alloys of the 7000 series.

The form of a CEP, beyond the requirement that it increases in cross-section from its inlet end to its outlet end, can vary substantially. The length of a CEP is variable, depending on the size of the casting to be made. The length can be from about 5 to about 40 mm, such as from 5 to 20 mm, and preferably about 10 to 15 mm. It may be convenient for a CEP to be of circular cross-section. However, other cross-sections such as square or rectangular can be used, depending largely upon the casting design and where the flow from the CEP enters the die cavity. A CEP may have an axis or centre line which is straight. However, a CEP can, if required, have an arcuate or bent axis or centre line, such that it provides a change in direction of alloy flow therethrough.

The dimensions and form of a CEP can vary in accordance with a number of variables. These include the size of castings being made; the type, size and power of the machine being used; the particular aluminium alloy being cast; the location at which alloy flows into the die cavity, and whether or not at least a portion of the CEP is defined by a region of the die cavity; and the microstructure being sought.

These variables can make it difficult to determine the suitable form for a CEP for a given casting to be made, at least if there is to be substantially complete control over that microstructure of a casting to be made. However, under appropriate conditions, it is found that a CEP can provide a casting which, for many purposes, has an optimum microstructure substantially throughout the casting. While some larger dendrites up to about 100 μm may come from the shot sleeve, in the case of a cold-chamber die casting machine, this microstructure is one characterised by fine degenerate dendrite primary particles in a matrix of secondary phase, with the primary particles less than 40 μm, such as about 10 μm or less. For this, the CEP is to be able to achieve alloy having a semi-solid state in its flow therethrough, in which the alloy possesses thixotropic properties, and also is to be able to maintain that state and those properties in the alloy substantially throughout flow of the alloy to fill the die cavity. For at least some forms of CEP able to achieve this, using a die mould providing for sufficiently rapid solidification of alloy therein, we have found that solidification of the alloy is able to progress back into the CEP such that alloy solidified in the CEP has a specific microstructure. While not necessarily definitive of all suitable forms for a CEP, attainment of that specific microstructure is one basis on which the overall requirements for a CEP can be quantified, at least where the indicated optimum casting microstructure for some applications is required or acceptable. However, this discovery is not limited to applications where that casting microstructure is required or acceptable since, as detailed herein, it is a microstructure able to be modified by heat treatment, if this is required for other applications.

The specific microstructure for a CEP is one which, in axial sections through metal solidified in the CEP, exhibits striations or bands which extend transversely with respect to the direction of alloy flow through the CEP and which result from alloy element separation. A CEP able to achieve such microstructure is one capable of generating intense pressure waves in the alloy in its flow through the CEP. The bands, which may extend laterally across substantially the full width of the CEP and along substantially its full length, are found to have a wavelength of the order of 200 μm. Also, the separation of elements is found to result in substantial separation of primary and secondary phases, with the primary phase present as fine, rounded or spheroidal degenerate dendrite particles substantially less than 40 μm in size, such as about 10 μm or less. Thus, for example, with an aluminium alloy having magnesium as its principal alloy element, such as the alloy CA313 (corresponding to the Japanese alloy ADC-12, the US alloy A380 and the UK alloy LM-24), it is found that alternate striations or bands are respectively aluminium-rich and magnesium-rich, due to separation of the more dense aluminium and less dense magnesium. The aluminium-rich bands are relatively richer in primary phase, present as fine, rounded or spheroidal degenerate dendrite particles substantially less than 40 μm in size, such as about 10 μm or less. In contrast, the magnesium-rich bands are found to be richer in secondary phase intermetallic particles, such as of the form $Al_xMg_ySi_z$.

Thus, according to a preferred form of the invention, there is provided a metal flow system, for use in pressure casting of an alloy, using a pressure casting machine, wherein the system includes a mould or die tool component in which a runner and a CEP define at least part of a flow path along which aluminium alloy is able to flow for injection into a die cavity defined by a mould or die; wherein the CEP, from the inlet end to the outlet end thereof, increases in cross-sectional area whereby the state of alloy in its flow through the CEP is able to be modified to achieve a semi-solid state possessing thixotropic properties and to enable the alloy in that state to flow into the die cavity; and wherein the CEP has a form such that, with solidification of alloy in the die cavity and back along the flow path into the CEP, to provide a resultant casting having a microstructure characterised by fine degenerate dendrite primary particles in a matrix of secondary phase, alloy solidified in the CEP has a microstructure in planes parallel to the flow direction characterised by striations or bands extending transversely with respect to the alloy flow therethrough, with the bands resulting from alloy element separation, and with alternate bands relatively richer in respective elements and respectively in primary and secondary phases.

The invention also provides a process for producing an article by high pressure casting, wherein substantially fully molten alloy is supplied under pressure to a metal flow system for flow along a flow path defined by the system to a die cavity defined by a mould or die; the flow path is defined at least in part by a mould or die tool component; and wherein the component is formed to define, as part of the flow path, a CEP which, from an inlet end to an outlet end thereof, increases in cross-sectional area whereby the state of the alloy in its flow through the CEP is modified to achieve a semi-solid state possessing thixotropic properties and to cause the alloy to flow in that state into the die cavity; the form of the CEP being provided such that, with solidification of the alloy in the die cavity and back along the flow path into the CEP, to provide a resultant casting having a microstructure characterised by fine degenerate dendrite primary particles in a matrix of secondary phase, alloy solidified in the CEP has a microstructure characterised by striations or bands extending transversely with respect to alloy flow therethrough, with the bands resulting from alloy element separation, and with alternate bands relatively richer in respective elements and respectively in primary and secondary phases.

The preferred system and process are to be such that, if solidification of alloy in the die cavity is sufficiently rapid, the respective microstructures are obtained. Such rapid solidification most preferably is achieved in use of the invention. However, in addition to the need for heat energy extraction from the mould or die to achieve this it can be necessary to control the temperature of the component defining the CEP such that alloy in the CEP is able to be solidified. Most conveniently, heat energy extraction is limited up-stream of the inlet end of the CEP, to enable a solid-liquid interface to be established at, or a short distance downstream from, the inlet end of the CEP.

The pressure casting machine with which the metal flow system of the invention is used can be of a variety of different forms. It may, for example, be a hot- or cold-chamber high pressure die casting machine having a nozzle from which alloy is able to be injected into the metal flow system, for flow along the flow path of the system and through the CEP of the flow path, to the die cavity. Alternatively, the machine may be of the Thixomatic type, such as disclosed for example in U.S. Pat. No. 5,040,589 (herein patent '589 to Bradley et al), in which alloy is advanced along a barrel to an accumulation chamber at one end of the barrel, and then ejected through a nozzle at the one end of the barrel by axially advancing the screw. From the nozzle of a Thixomatic type of machine, the alloy is able to be injected into the metal flow system, again for flow along the flow path of the system, through the CEP of the flow path, to the die cavity.

In a further alternative, the machine may be of the type disclosed in our Australian provisional application (attorney reference IRN642429), entitled "Apparatus for Pressure Casting" filed on Aug. 23, 2001. The disclosure of that provisional application is incorporated herein by reference, and is to be read as forming part of the disclosure of the present invention. In that disclosure of our Australian provisional application (IRN 642429), there is provided a molten alloy transfer vessel having a capacity for holding a measured volume of alloy required for transfer to a die tool and sufficient to produce a given casting, or for simultaneously producing a plurality of given castings which usually are similar. With a machine having such transfer vessel, the alloy in the transfer vessel is able to be discharged via an outlet port by pressurising an upper region of the vessel. From such discharge port, the alloy is able to be injected into the metal flow system as described above for the other machine types.

It is indicated above that the present invention enables production of castings having an optimum microstructure substantially throughout. That microstructure is indicated as having fine degenerate primary particles in a matrix of secondary phase, with the primary particles less than 40 μm, such as about 10 μm or less. However, it also is indicated that some larger dendrites ranging up to about 60 to about 100 μm can be present. Those larger particles are indicated as having come from the shot sleeve, reflecting use of a cold-chamber die casting machine. With use of a hot-chamber machine, this influx of larger dendrites can be avoided, providing a casting with only fine primary particles less than about 40 μm. However, even with use of a cold-chamber machine, the volume fraction of such larger particles can be kept to a relatively low level.

A conventional hot-chamber die casting machine is not suited to use in pressure casting of aluminium alloys, due to its components being attacked by the alloy. Thus, this type of machine enables practical avoidance of larger dendrite particles only in so far as new materials not attacked by aluminium alloys are used or become available. However, a machine of the type disclosed in our above-mentioned provisional application (IRN 642429) provides an alternative form of hot-chamber die casting machine and, as it is amenable to manufacture of materials not attacked by aluminium alloys, the use of its machine does enable avoidance of larger dendrite particles. Thus, use of the present invention in a machine as disclosed in that provisional application (IRN 642429) enables production of castings, by high pressure hot-chamber die casting, which are substantially free of primary dendrites in excess of 40 μm.

As indicated above, it is highly desirable that the alloy has a flow velocity at the outlet end of a CEP which is close to or within a preferred range. The flow velocities indicated are high relative to flow velocities used in high pressure die casting machines and in a Thixomatic type of machine. As the alloy flow velocity decreases as the alloy passes through the CEP, due to the CEP increasing in cross-section in the flow direction, the flow velocity at the inlet end of the CEP therefore needs to be even higher. The flow velocity of the alloy through the outlet end of the CEP preferably is 20 to 50% less, such as 25 to 35% less, than the flow velocity at or upstream of the inlet end of the CEP. In many instances, the outlet flow velocity may be about two-thirds of the flow velocity at or upstream of the inlet end such that, with an outlet flow rate of about 60 m/s, the flow velocity at or upstream of the inlet to the CEP may be about 90 m/s. The machine with which the metal flow system is used needs to have an alloy output flow velocity which is consistent with these requirements or, for a given machine, the metal flow system needs to have a CEP with inlet and outlet end cross-sectional areas which are consistent with attaining the required flow rates for the CEP from the output flow velocity for the machine. Thus, for a machine providing a relatively low output flow velocity, such as due to a low piston velocity, the inlet and outlet cross-sectional areas of the CEP will need to be small, resulting in an extended flow time.

With use of a metal flow system according to the present invention, having a CEP in which solidified alloy is able to exhibit a microstructure characterised by striations or bands resulting from alloy element separation, it is believed that the microstructure obtained in a resulting casting is unique. That microstructure is broadly detailed above, in terms of it having fine, degenerate dendrite primary particles in a matrix of secondary phase, with the primary particles less than 40 μm but with some larger dendrites up to about 100 μm coming from the shot sleeve if a cold-chamber machine is used. The primary particles not only are small, frequently about 10 μm or less, but they also are evenly distributed. Moreover, the microstructure is able to be obtained substantially fully throughout a casting produced by the process of the present invention. A further more important factor is one which results from the alloy element separation which occurs in the CEP under the conditions which cause the alloy to achieve a semi-solid state possessing thixotropic properties. It is found that the microstructure of the casting reflects this separation in at least the degenerate dendrite primary particles of the casting, as with the primary particles in the striated or banded microstructure of alloy solidified in the CEP, as explained in the following.

With normal growth of dendrites, the core or first part to solidify is relatively rich in aluminium. As the dendrites grow, the concentration of a secondary element in the surrounding molten alloy accordingly increases, due to the removal of the aluminium, while the concentration of the aluminium in the surrounding melt decreases. Thus, the growing dendrite exhibits a graded ratio of aluminium to secondary element from its core or centre, with aluminium decreasing and the secondary element increasing in concentration. Thus, with an aluminium alloy containing magnesium, such as the alloy CA313, normal dendrite growth gives rise to dendrites which have an aluminium-rich core or centre but which, from the core or centre, have a decreasing aluminium content and an increasing magnesium content. However, the alloy element separation resulting from the CEP, in a metal flow system according to the present invention, gives rise to alloy element separation on the basis of density, and modification of the normal growth. This modification results in a fluctuating variation in alloy elements from the core or centre of the degenerate dendrite particles which, instead of being gradual and substantially uniform, is more of a decaying sinusoidal form. Thus, while the core or centre is richer in aluminium and relatively low in the secondary element, the secondary element first rises, then falls and thereafter can rise again in directions outwardly from the core or centre. Thus, with an aluminium alloy such as CA313, the particles are low in magnesium at the core or centre but, from there, the magnesium content initially increase relative to aluminium over about an initial third of the radius of the degenerate dendrite particles, then decrease relative to aluminium over about the second third of the radius, and thereafter increase again to the outer perimeter of the particles. This modification occurs in the CEP, and is able to be retained in primary particles with flow of the alloy into the die cavity.

The fluctuating ratio of aluminium and secondary alloy elements in the degenerate dendrite primary particles results from the conditions generated by the CEP. Computer simulations of flow conditions through a CEP generating a striated or banded microstructure indicate that, with flow of alloy through a suitable form of CEP which achieves the indicated flow rates through the outlet of the CEP, intense pressure waves are generated in the alloy. The simulations indicate that the pressure waves are at a level of about ±400 MPa. It is known that pressure differences of the order of a few 100 kPa can cause separation of less and more dense elements of an alloy, such as magnesium and aluminium. The computer simulations therefore point to pronounced separation, with movement of a less dense element to high pressure pulses and of a higher density element to low pressure pulses. Moreover, the computer simulations suggest that the intense pressure waves will have a wavelength of about 40 μm. This is found to accord very closely with results achieved in practice. As indicated above, it is found that, for alloy solidified in a CEP under conditions providing for relatively rapid solidification in a die cavity, and back into the CEP, the resultant striations or bands in the microstructure of alloy solidified in the CEP have a wavelength of about 200 μm. That is, the spacing between centres for successive like bands, of primary element or secondary element, is about 40 μm.

BRIEF DESCRIPTION OF THE DRAWINGS

In order that the present invention may more readily be understood, reference now is made to arrangements illustrated in the accompanying drawings.

DETAILED DESCRIPTION OF THE PREFERRED EMBODIMENTS

Experimental Example

Figure 1:
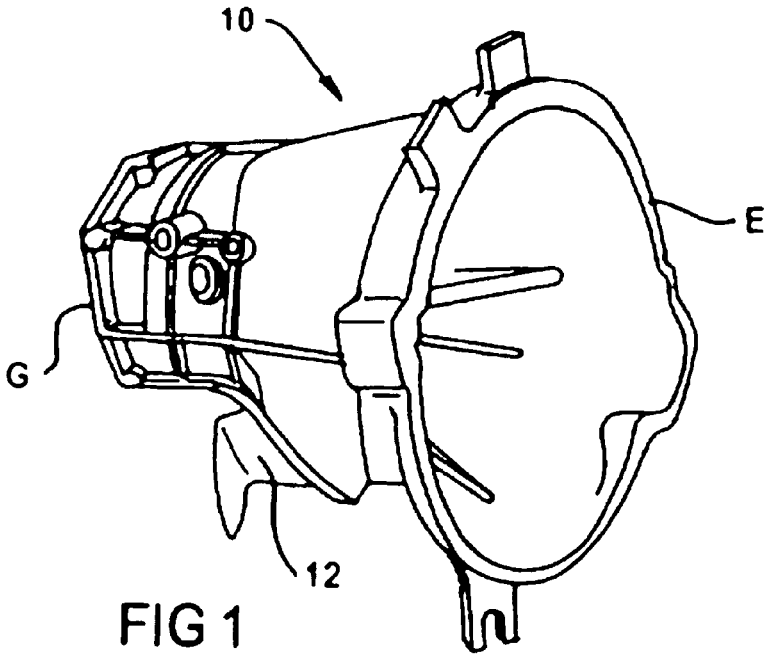
FIG 1 (PRIOR ART)
FIG. 1 is a perspective view, from the engine end, of a conventional die cast automotive transmission case.

A trial, conducted to explore the practicability of casting an aluminium alloy product, using metal flow systems in accordance with the present invention, was conducted using an Ube 1250 t high pressure cold-chamber die casting machine at an automotive die casting plant. The trial involved casting automotive transmission cases from CA313 aluminium alloy. For this, six experimental flow paths were machined into respective cast runners which had been trimmed from production castings, to form six different metal flow systems according to the invention. By placing each of these runners, with its machined flow system, back into the die casting tool of the Ube casting machine, and casting through each flow system, respective transmission cases were cast. The runner/CEP shapes were designed to enable evaluation and comparison of various ways of directing the molten aluminium alloy into the die cavity by achieving high speed alloy flow through each runner/CEP before injection into the die cavity.

The transmission cases were comparable in quality, and in one case superior, to production castings made with a conventional tapered tangential runner system which produced the trimmed runners subjected to machining. As detailed below, each experimental, machined flow path providing one of the six metal flow systems according to the invention was much smaller in cross-section and mass, demonstrating that it is possible and practical to produce large aluminium alloy die castings using flow systems which result in substantially less remelt from each casting, without loss of quality.

As indicated above, runners were obtained from normal production of six high pressure die cast aluminium alloy automotive transmission cases produced

| | |
|---|---|
| Melt temperature: | 635° C. |
| Aluminium alloy: | CA313 |
| Approx wts (measured): | |
| Casting: | 8.7 kg |
| Runner: | 0.75 kg |
| Biscuit: | 2.5 kg |
| Total: | 11.95 kg. |

The conditions were the same for the experimental trials, except that the runner metal solidified in the new runners ranged from about 0.05 kg to about 0.13 kg, in contrast to the 0.75 kg for the normal production castings.

The Ube die casting machine used for the trials was in full production mode before the trial began. Each new runner/CEP was placed in the sliding cores of the die in respective casting operations and held there by a liberal amount of silicone sealant.

Respective trial castings in accordance with the present invention, using each new runner/CEP, are illustrated schematically in FIGS. 4 to 9. In each case, the shape of the respective new runner/CEP is shown and designated as R. However, for ease of illustration, the production runners drilled to provide each new runner/CEP is omitted from FIGS. 4 to 9.

Each production and experimental casting was examined using X-ray inspection techniques both in-plant, by production quality control personnel, and again by a more thorough laboratory examination. The results of the examination showed that the experimental castings made with each new runner/CEP was comparable to the castings made in normal production. One experimental casting contained the least amount of porosity of all castings examined, including normal production castings collected during the trial run.

Figure 2:
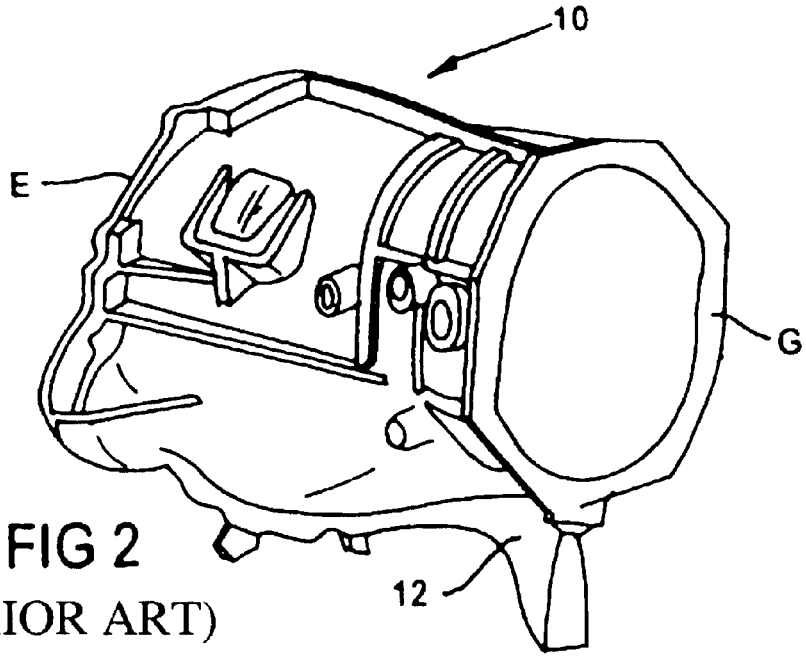
FIG 2 (PRIOR ART)
FIG. 2 is a perspective view of the transmission case of FIG. 1, taken from the gearbox end.

Sections were cut from the production and trial runner castings. Bosses at diagonally opposite corners of the castings were removed to examine the microstructure of the metal and the type of porosity present. The bosses were polished approximately 10 mm below the surface and parallel to the two mating flanges at either end of the casting. The polished bosses then were etched and examined under an optical microscope at magnifications up to 1000×. The locations of the bosses cut from each of the experimental castings for examination were the same as for the normal production castings. using a conventional tapered tangential runner system. FIGS. 1 and 2 are perspective views from the engine end E and the gearbox end G, respectively, of one of the transmission cases produced by a normal production cycle using the conventional tapered tangential runner system. In FIGS. 1 and 2, the case is shown at 10, with its still attached runner metal shown at 12.

Figure 3:
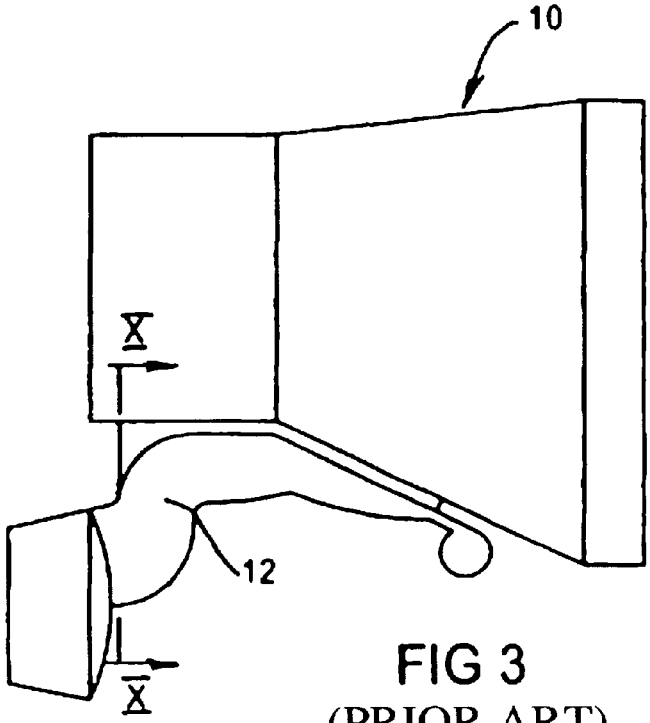
FIG 3 (PRIOR ART)
FIG. 3 is a schematic side elevation of a production casting as in FIGS. 1 and 2.

In the schematic side elevation of FIG. 3 the sprue/runner metal 12 shown prior to being trimmed from the case 10. As indicated, the sprue/runner metal 12 was carefully removed from a number of cases as in FIGS. 1 and 2, produced in accordance with normal production practice. The runners were separated and collected, and as shown in FIG. 3, the metal 12 was cut approximately on lines X—X to provide the collected runner metal sections 14.

The respective experimental flow path machined into each cast runner trimmed from a production casting, when placed, in turn, back into the die casting tool of the Ube machine, then became "a new runner/CEP" for casting a transmission casing. That is, the flow path provided a metal flow system according to the invention through which CA313 aluminium alloy flowed to reach the tool die cavity. Each of the six flow paths was designed to have reduced cross-sectional area to the die cavity, and to achieve high velocity metal flow into the cavity. During the trial, the settings for the Ube die casting machine were not changed from their production values. For example, plunger velocity remained as set for production cast of transmission cases using the conventional tapered tangential runner. As a result, a higher velocity ($V_r$) for alloy entry to the die cavity was the product of the plunger velocity ($V_b$) and the ratio of plunger cross-sectional area ($A_p$) to flow-path (i.e. new runner) cross-sectional area ($A_r$), as represented by:

$$V_r = V_p \cdot \left(\frac{A_p}{A_r}\right).$$

Between successive trial castings, using a metal flow system according to the invention, five production castings were made using the conventional tangential runner system. The third and fifth of the production castings were collected for examination and comparison with the trial castings.

The casting conditions for normal production were as follows:

Ube 1250 t high pressure die casting machine.

The bosses were preferentially sectioned because they commonly contain porosity due to their thickness. The indicated locations for the particular bosses were chosen because they represented the two furthermost points from the runner at both ends, a location close to the runner and a location that X-ray inspection showed to commonly contains porosity. The third of the five normal production castings made between successive experimental castings was sectioned at the latter two locations to compare the microstructures with the experimental castings.

The type of porosity observed in castings made during the trial was a combination of gas and shrinkage localised in the thicker boss sections. This is common in castings where the bosses are fed through a much thinner cavity section, in this case the 20 mm thick bosses were fed through a cavity section of 5.5 mm thick. There was no significant difference between the type of porosity found in trial castings and production castings, only variations in size, number and location.

X-ray inspection of 57 locations around each casting showed that the porosity tended to localise at the centre of the bosses and in the thicker sections between bosses where shrinkage was most likely to occur. The porosity commonly appeared as a collection of small gas/shrinkage pores rather than a large shrinkage tear or a large isolated gas pore. Polished sections of bosses showed that pore numbers ranged from a few to around 100 within a boss and ranged in size from about 50 to 500 μm. Larger pores, 4 to 5 mm diameter, were sometimes found in both production and trial castings, these tended to be at locations where the flow during cavity fill may have trapped pockets of gas.

Of the castings inspected, one trial casting (that depicted in FIG. 9) had porosity at approximately half the number of locations compared to the production castings and the porosity mostly consisted of fine dispersed gas/shrinkage. The other trial castings of FIGS. 4 to 8 were of similar quality to the production castings.

Experience with current systems would lead to anticipation of more porosity in the experimental castings of FIGS. 4 to 9 using the new runners, than in production castings as in FIG. 3 which had been optimised over many years, but this did not occur. Overall the experimental castings illustrated by FIGS. 4 to 9 have shown that the transmission case could be made with a much reduced runner size at equal if not better casting quality.

Figure 4:
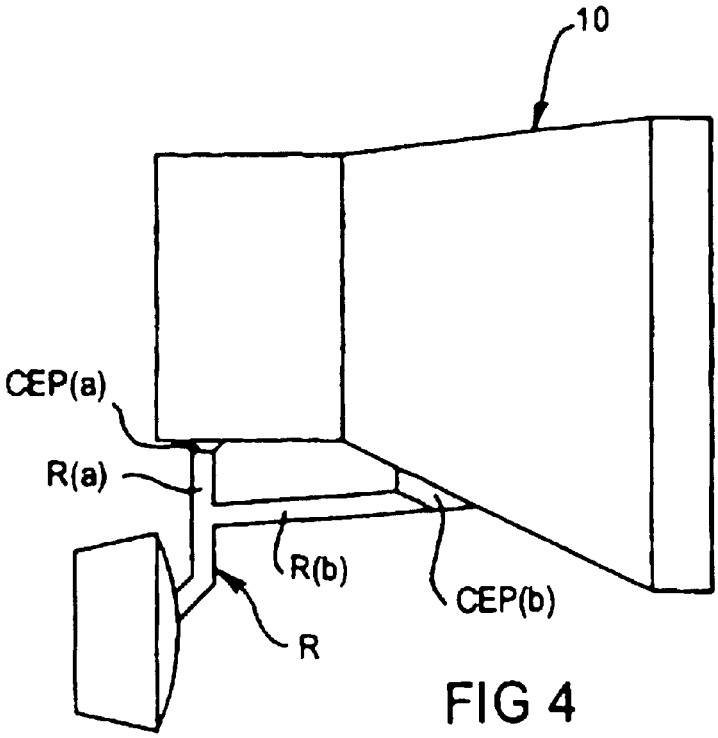
FIGS. 4 to 9 correspond to FIG. 3 but show respective experimental castings of transmission cases as in FIGS. 1 and 2, each produced with a respective experimental metal flow system according to the present invention.
Figure 5:
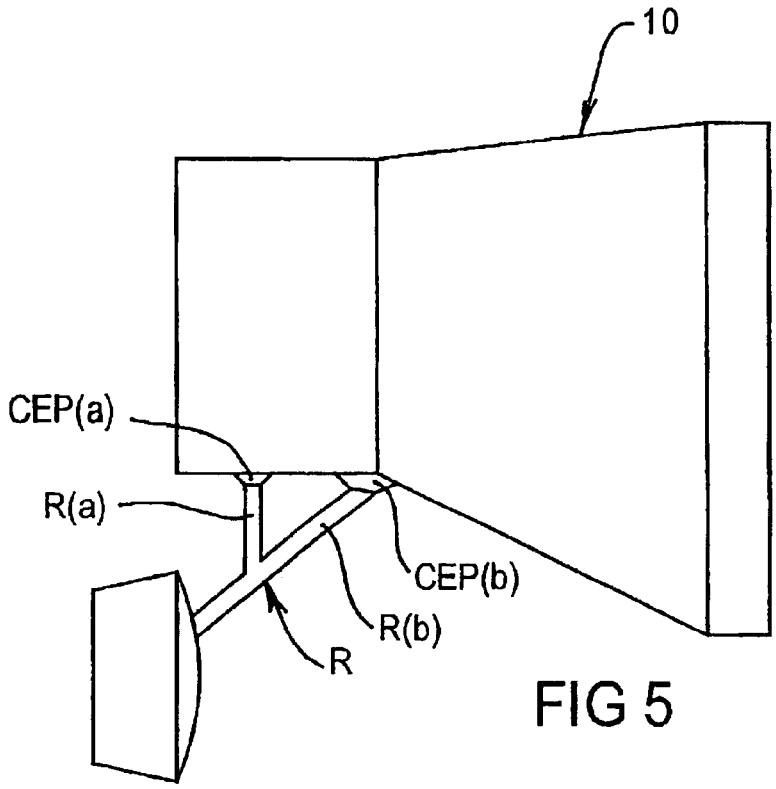
Figure 6:
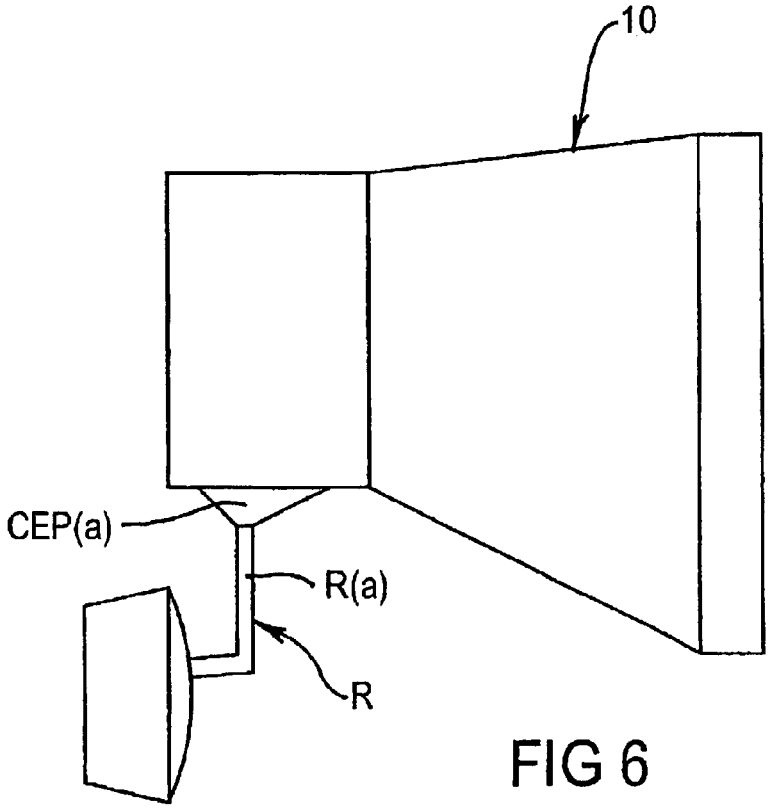

The new runner system R of FIG. 4 for producing an experimental casting 20 has a first straight-through channel R(a) from which a second channel R(b) extends substantially at right angles. The channels R(a) and R(b) are of 20 mm diameter and each ends in a respective CEP(a,b) of increasing tapered cross-section which opens to the die cavity for casting 20. The runner system R of FIG. 5 is similar to that of FIG. 4, except that channels R(a,b) are at an acute angle of about 50° and each is 9 mm in diameter. The system R of FIG. 6 has a single channel R(a) and CEP(a), although the channel R has sections mutually inclined at about 105° and is 20 mm in diameter.

Figure 7:
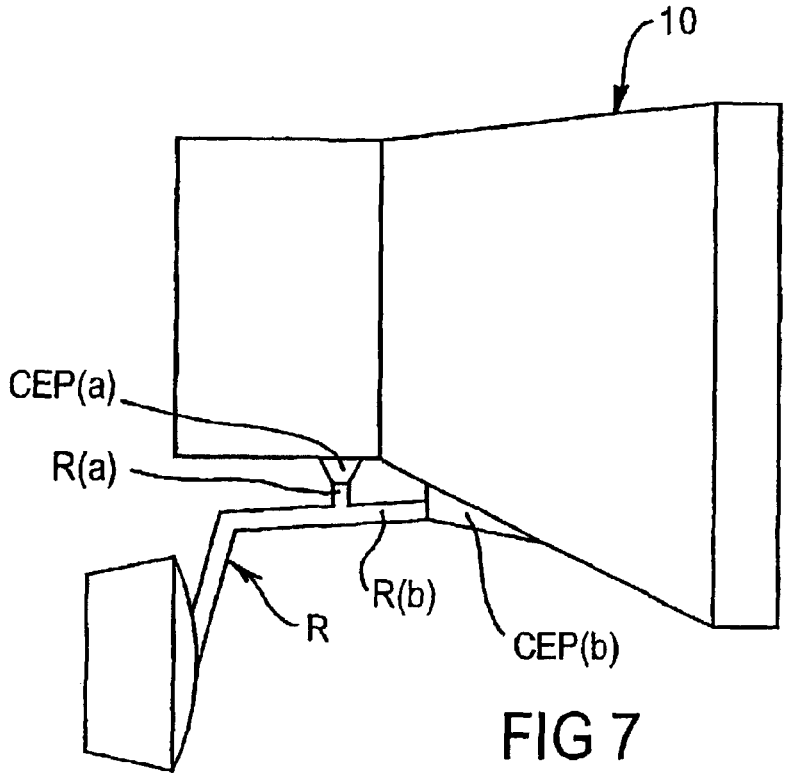
Figure 8:
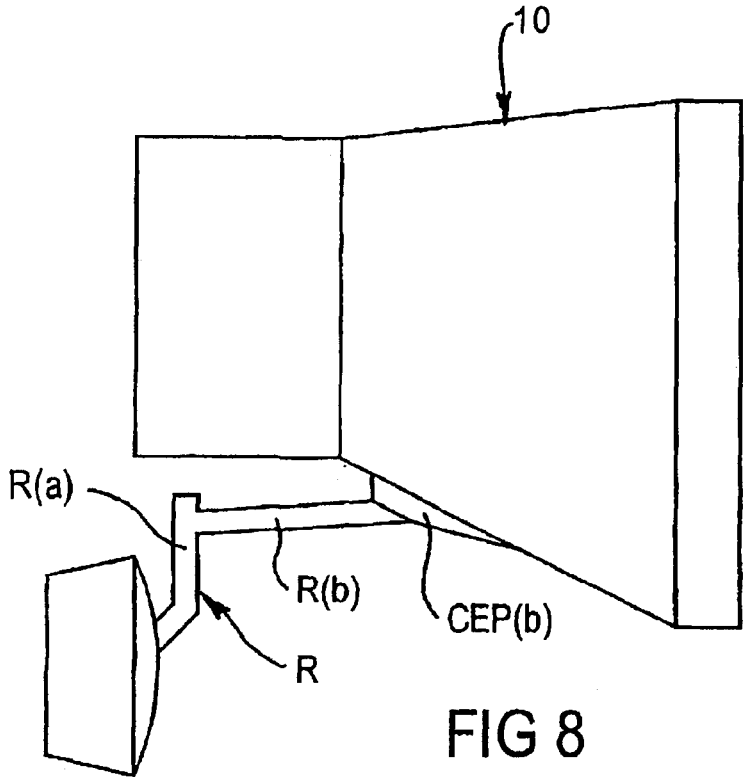
Figure 9:
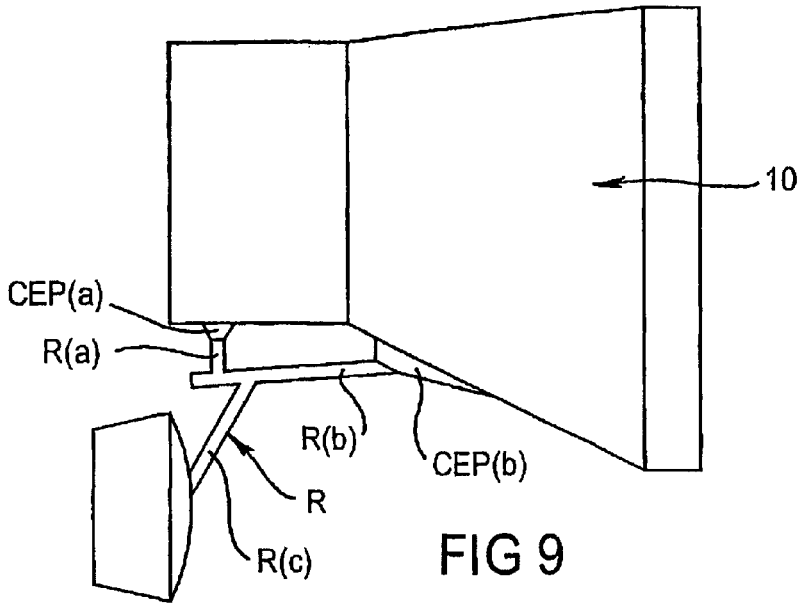

The arrangement of the runner system R of FIG. 7 is similar to that of FIG. 5. However, the channel sections R(a) and R(b) are relatively short and of 9 mm diameter, and the lead in channel R(c) is cranked and of 12 mm diameter. The system R of FIG. 8 is similar to that of FIG. 4 except that it is of 12 mm diameter and channel branch R(a) is short and terminates at a blind end. FIG. 9 has an arrangement similar to that of FIG. 4, except that channel sections R(a) and R(b) are 9 mm in diameter and lead in section R(c) is of 18 mm diameter. Also, in FIG. 9, section R(c) joins section R(b) intermediate CEP(b) and the junction between sections R(a) and R(b), while CEP(b) increases in cross-section from that of runner section R(b) but is asymmetrical so as to have a relatively larger dimension axially of the die cavity for casting 40.

The experiment illustrated in FIGS. 4 to 9, involving trial runner shapes and channels drilled into previously cast runners, makes clear that a reduction in runner size and hence a reduction in scrap, is able to be obtained without a loss of casting quality using the metal flow system of the present invention. The metal velocities through the experimental flow systems were higher than through conventional runner systems. Microscopic examination of sections from both production and experimental castings showed no significant difference in microstructure. This industrial experiment has shown that a transmission casting made in CA313 aluminium alloy could be made with a much reduced metal flow system with consequent savings in remelt cost and improved quality.

Figure 10:
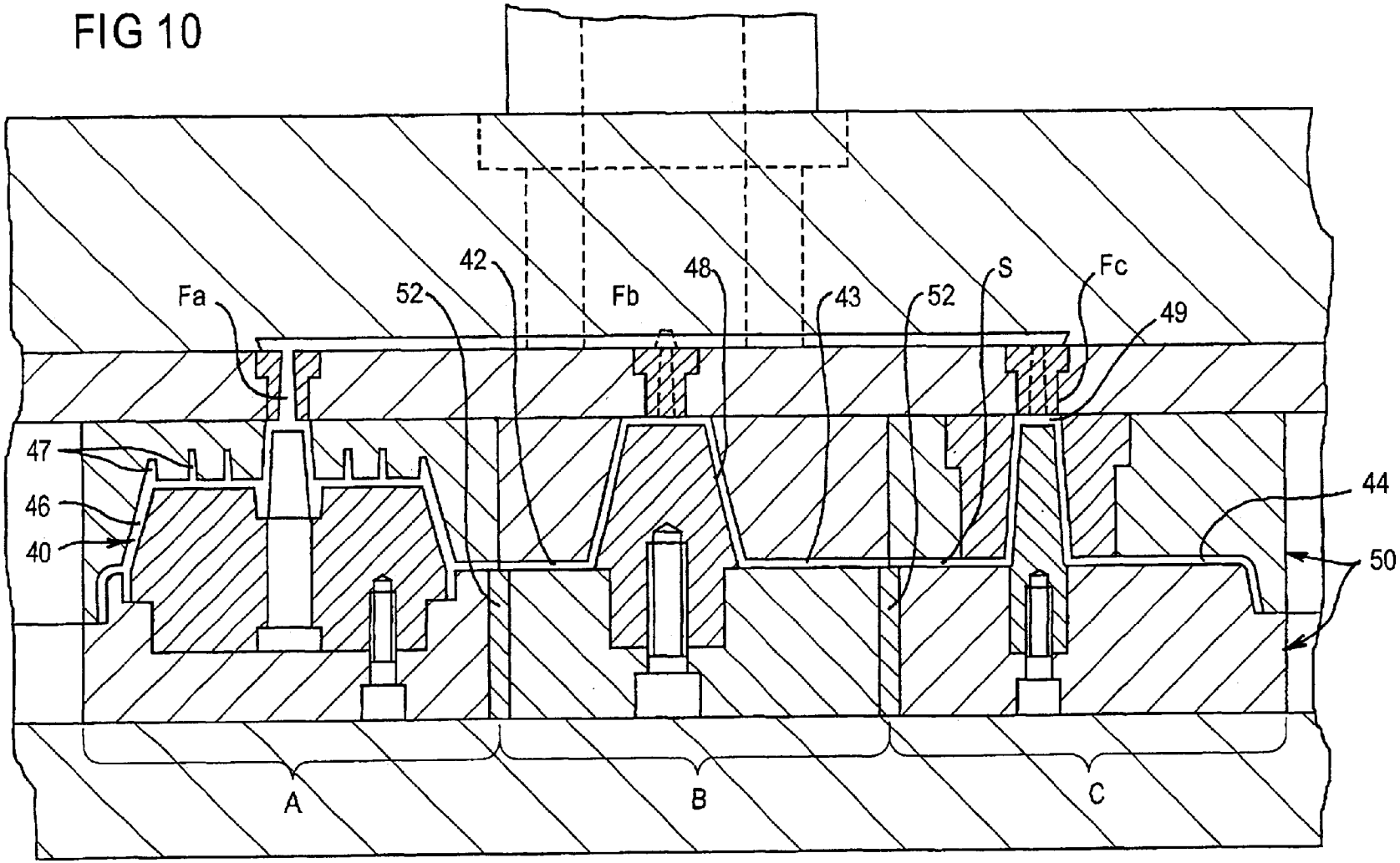
FIG. 10 is a longitudinal sectional view illustrating a trial casting of complex form, using a metal flow system according to the present invention.
Figure 13:
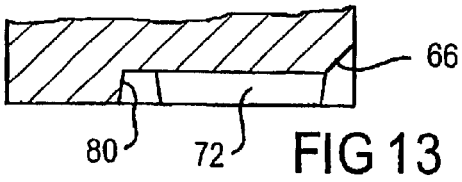
FIG. 13 is a sectional view on line B—B of FIG. 11.
Figure 11:
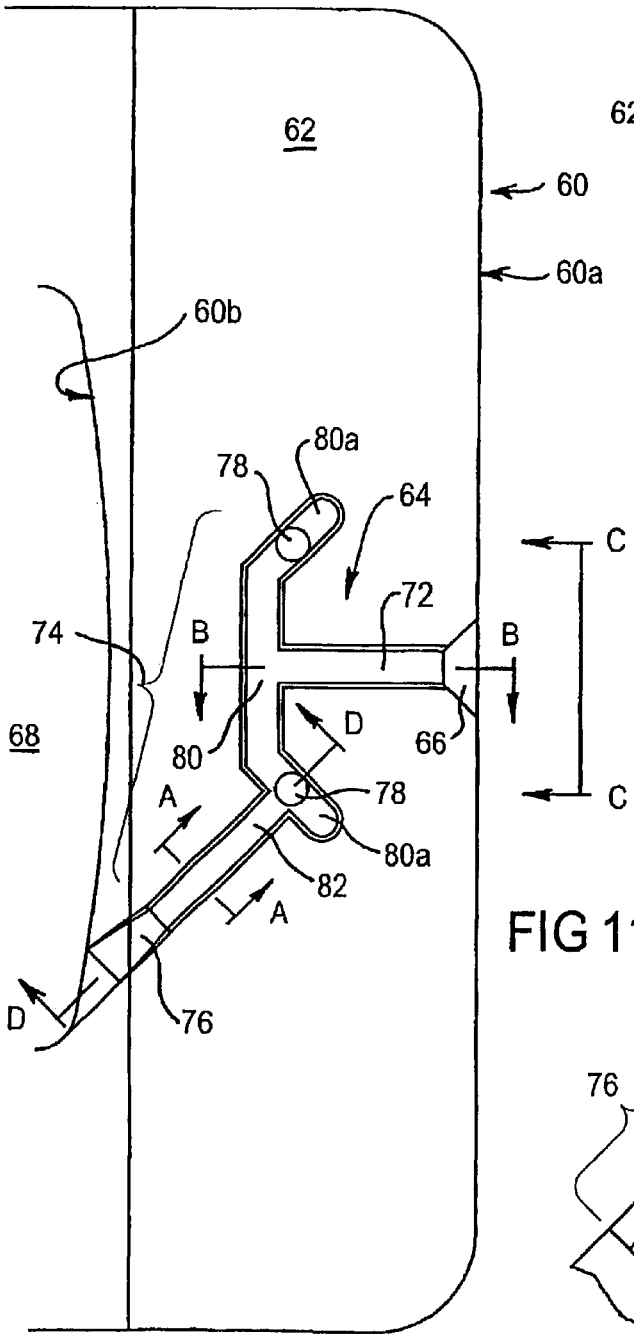
FIG. 11 is a plan view of part of a die for pressure casting of aluminium alloy, illustrating a metal flow system according to the invention.
Figure 12:
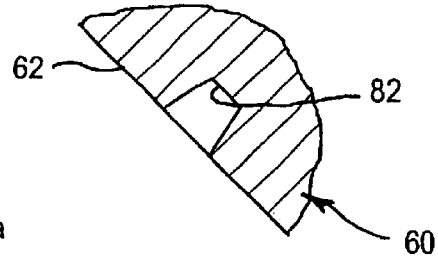
FIG. 12 is a sectional view taken on line A—A of FIG. 11.
Figure 14:
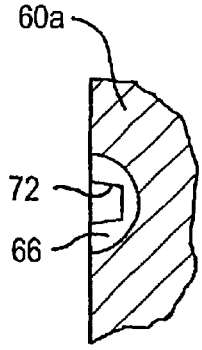
FIG. 14 is a partial end elevation taken on line C—C of FIG. 11.
Figure 15:
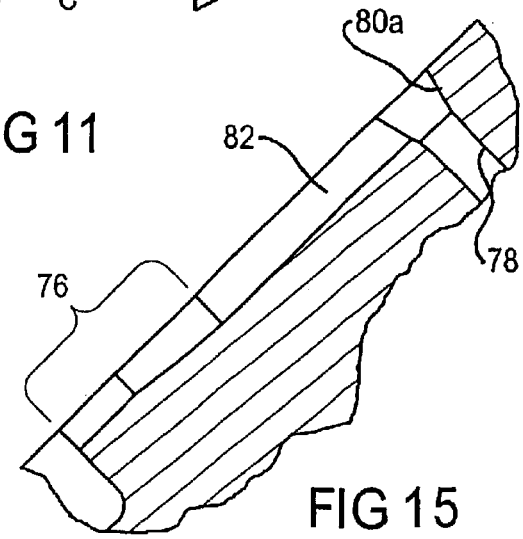
FIG. 15 is a sectional view taken on line D—D of FIG. 11.

With reference now to FIG. 10, there is illustrated the production of castings 40, made using CA313 aluminium alloy on 250 tonne Toshiba cold chamber machine. The casting 40 has broad, flat areas 42, 43 and 44, a difficult box shaped area 46 with cross-ribs 47 and bosses 48 and 49. The casting had a length of 380 mm in the plane of the section of FIG. 10 and a width perpendicular to that plane of 150 mm, giving a projected area of 570 $cm^2$.

The die 50 used for casting 40 was designed to allow the option of feeding the three impressions A, B and C singly or in multiples. Each impression A, B and C has its own feeding bush $F_a$, $F_b$ and $F_c$ respectively and its own temperature control, with main runner $R_m$ extending to all three of the feeding bushes. The impressions are able to be varied in position and, if required, spacers 52 of greater width can be used to isolate adjacent impressions.

As is evident from FIG. 10, casting 40 was produced using all three impressions. However, feed bushes $F_b$ and $F_c$ were blocked and all alloy feed was through a CEP defined at a CEP defined by bush $F_a$, through impression A to impressions B and C. The casting filled without difficulty and was of good quality and definition throughout, with minimal porosity.

Successive castings 40 were made using respective bushes $F_a$, each defining a respective CEP. In each case, the runner $R_m$ was the same and comprised a channel of bi-laterally symmetrical trapezoidal cross-section. The channel had a depth of 4.5 mm and a mid-height width of 4.5 mm, giving a cross-sectional area of 20.25 $mm^2$. Each bush had a tapered bore of circular cross-section which defined its CEP. Each CEP was 20 mm long, with a respective inlet and exit diameter and cross-sectional area as follows:

| | Diameter (mm) | | Exit Area ($mm^2$) | |
|---|---|---|---|---|
| Bush | Inlet | Exit | Inlet | Exit |
| I | 4 | 6 | 12.6 | 28.3 |
| II | 5 | 7 | 19.6 | 38.5 |
| III | 7 | 9 | 28.5 | 63.6 |

Thus, the exit cross-sectional area of each CEP was substantially larger than the cross-sectional area of the runner $R_m$. Even in the case of bush I, the CEP area was about 40% larger than the runner area. Bushes I and II each had an inlet cross-sectional area less than that of runner $R_m$, although it is the exit area that is material. With each of bushes I, II and III, castings 40 of excellent quality were produced, despite the complex form.

In a further trial, a short shot was made with the die of FIG. 10 to check the filling mode. This resulted in about a two-thirds casting through to region S in impression C. Again, the casting was of good quality and definition, with minimal porosity.

The edge of the short shot casting at region S was in a near straight vertical line across the die cavity. The edge was of semi-rounded form. This unusual filling mode is typical of a "solid front fill" achieved with use of the present invention; that is, with high speed injection with the aluminium alloy in a semi-solid state.

Turning now to FIGS. 11 to 15, the die part 60 shown therein has a planar inner surface 62 by which it mates with a similar complementary part (not shown). The complementary die parts define a metal flow system according to the present invention, a major part of which is shown at 64 in FIG. 11.

The metal flow system 64 provides for metal flow between a casting machine nozzle (not shown), when the outlet end of the nozzle is applied against frusto-conical seat 66 defined in the outer face 60*a* of part 60, and a die cavity 68 (partly shown) which is defined in part by the inner surface 60*b* of die part 60. The system 64 includes a sprue channel 72, leading inwardly from seat 66, a runner system 74 extending from sprue bore 72, and a CEP 76 at the inner end of system 64 which communicates with die cavity 68. The die part 60 also has holes 78 which extend outwardly away from surface 62, from respective locations within runner system 74, with each of holes 78 able to accommodate an ejection pin (not shown) for use in ejecting sprue/runner metal attached to a casting produced in cavity 68.

One half of seat 66 is formed in die part 60, with its other half formed in the complementary die part. However, beyond this, the other die part may have a planar surface free of any machining and which simply closes system 64 inwardly from seat 66 to die cavity 68.

The runner system 74 includes a main, transverse runner 80 which extends across the inner end of, and forms a T-shape with, sprue channel 72. At each end, runner 80 has a respective end portion 80*a*, with portions 80*a* diverging from each other towards outer face 60*a* of die part 60. A respective one of ejector pin holes 78 communicates with each portion 80*a* of runner 80. System 74 also includes a secondary runner 82 which, at one end, extends from one of the portions 80*a* of main runner 80 to CEP 76, from a location intermediate the ends of portion 80*a*.

While the form of the part of seat 66 in die part 60 is semi-circular in cross-sections parallel to face 60*a* of die part 60, sprue channel 72, CEP 7*b* and runners 80 and 82 have cross-sections which are of substantially bi-laterally symmetrical trapezoidal form, although other geometries can be used. Sprue 72 and main runner 80 each have a cross-sectional area of about 66 $mm^2$, while runner 82 has a cross-sectional area of about 14.4 $mm^2$. CEP 76, in a first part 76*a* extending away from runner 82, increases in width, but decreases in depth, such that its cross-sectional area increases from that of runner 82 to a maximum of about 16.3 $mm^2$. From part 76*a* to die cavity 68, CEP 76 has a part 76*b* of constant depth but, the effective width of part 76*b* decreases due to part 76*b* approaching inner surface 60*b* of part 60 at an acute angle. However the overall effect is that the cross-sectional area of CEP 76 is greater than the area of runner 82, such that aluminium alloy flowing through system 64 will have a greater flow velocity in runner 82 than in CEP 76.

With use of an aluminium alloy casting installation having the arrangement of FIGS. 11 to 15, articles are able to be cast in successive casting cycles in die cavity 68. With the die casting machine operating at its usual casting pressures for use with a current system, aluminium alloy, supplied by the machines nozzle applied to seat 66, flows through sprue channel 72 and runner system 74, and is injected into cavity 68 via CEP 76. The relatively small cross-sectional areas of runners 80 and 82 is such that at the usual casting conditions, the flow velocity for aluminium alloy through the runners is able to be in a suitable range of 80 to 110 m.sec$^{-1}$. Similarly, the cross-sectional area of part 76*a* of CEP 76 is such that the alloy flow velocity through CEP 76 is able to be in a suitable range of about 65 to 80 m.sec$^{-1}$. As a consequence, the alloy flow is turbulent.

The turbulence is increased by the sharp change in flow direction for aluminium alloy passing from sprue channel 72 to runner 80, into part 80*a* of runner 80 and from the latter into runner 82. It also is increased by the presence of alloy passing into the blind end of part 80*a*, beyond the inlet end of runner 82. Despite these matters, the indicated flow velocities, and the angle at which CEP 76 directs the alloy into die cavity 68, good quality castings are able to be produced, whether at the higher or lower temperature conditions detailed earlier herein.

Figure 16:
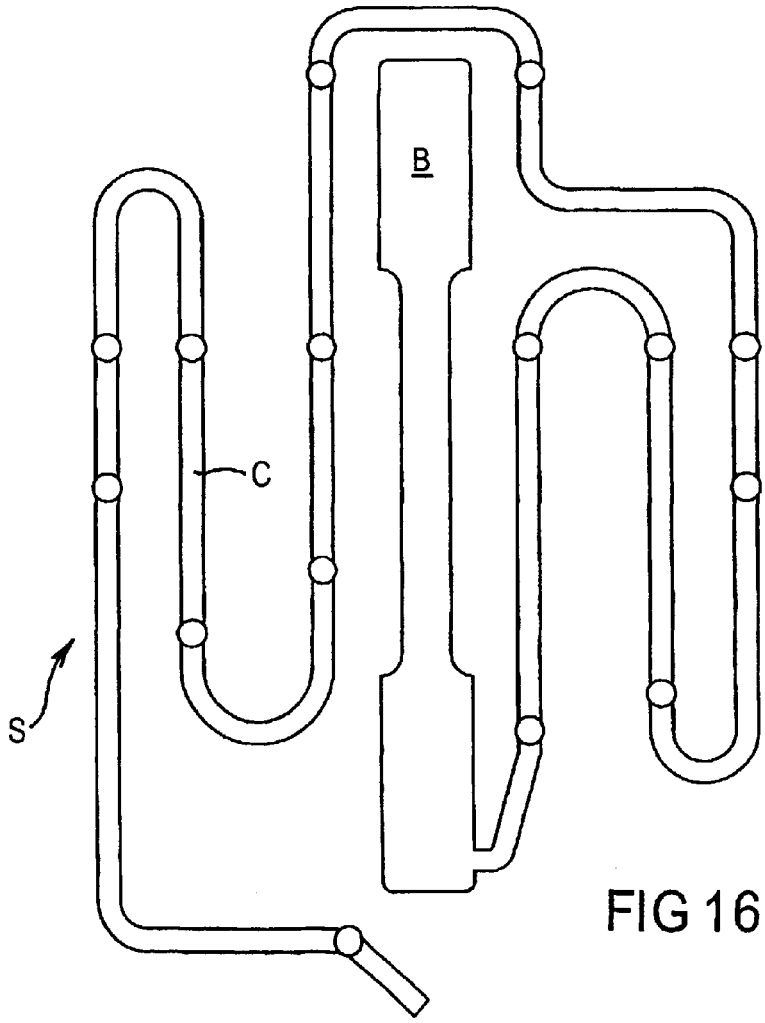
FIG. 16 is a schematic representation of an experimental casting illustrating alloy travel with use of a metal flow system according to the present invention.

FIG. 16 is a schematic representation of an experimental casting exercise, aimed at testing the distance aluminium alloy is able to travel during casting in accordance with the present invention, without freezing up. As shown in FIG. 16, there was created a metal flow system S consisting of a channel C providing a metal flow path ending in a standard tensile bar impression B. The channel C had a nominal cross-section of 4×4 mm and a length of 1230 mm.

Casting trials were carried out with the system S of FIG. 16, on a 250 tonne cold chamber die casting machine. The trials were conducted under normal machine operating conditions for the machine, normal die temperatures and using a metal flow system similar to that of FIGS. 11 to 15. As will be appreciated from FIG. 16, the path of channel C is of a tortuous nature, creating high resistance to flow. Despite this, flow along the full 1230 mm length of the channel C was achieved, enabling filling of the bar impression B. The flow length of 1230 mm is considered not to be a limit.

Figure 17:
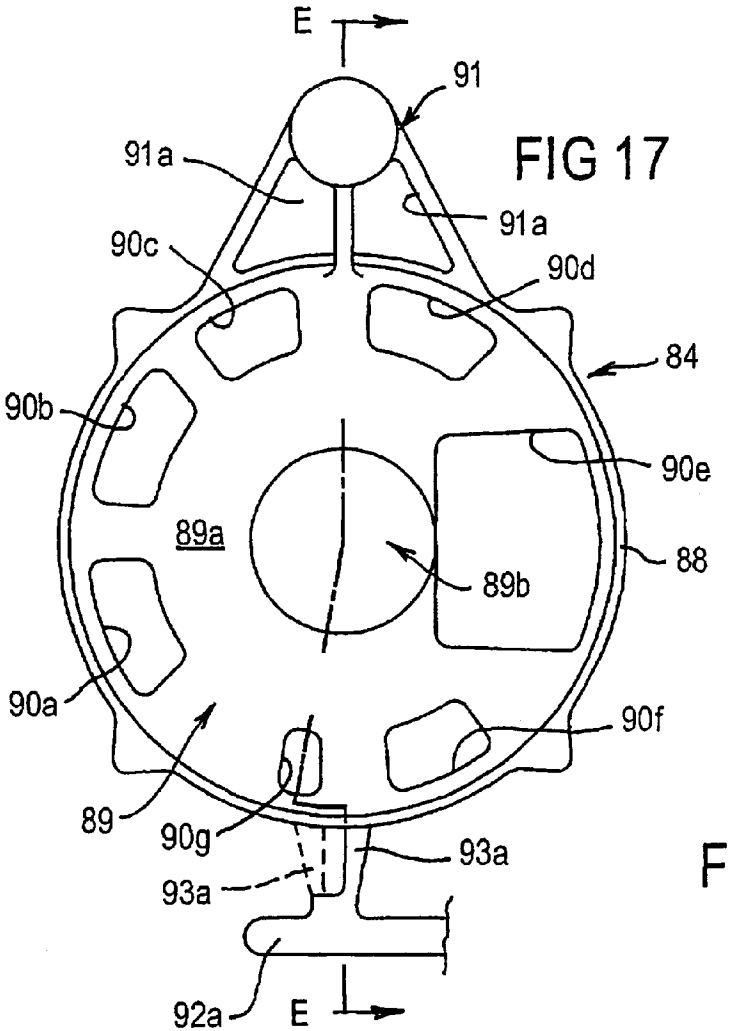
FIG. 17 is a plan view of a casting produced according to the present invention as removed from the die tool in which it was produced.

With reference to FIG. 17, there is shown a casting, comprising an alternator casing 84 produced with a metal flow system according to the present invention. In successive casting cycles, respective casings 84 were cast, using either a single CEP or two CEPs. In the latter case, the two CEP were closely adjacent, and received alloy from a common runner. The runner/CEP arrangements are detailed more fully below.

Figure 18:
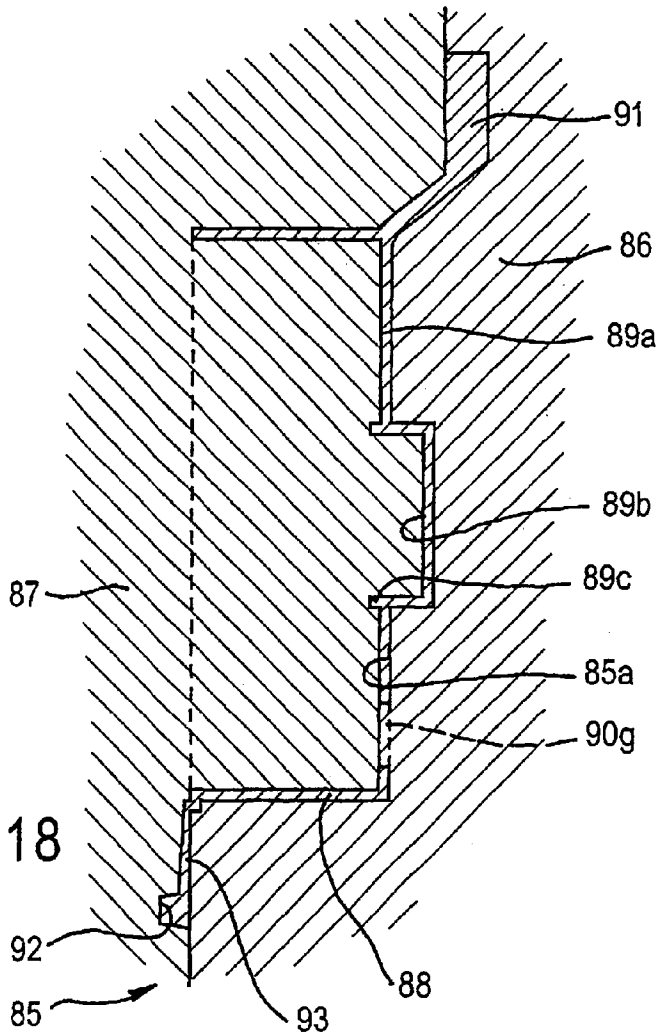
FIG. 18 is a sectional view of the casting of FIG. 17, before removal from the die tool, taken on line E—E of FIG. 17.

FIG. 18 shows the casing 84 prior to its release from a die tool 85 having a fixed die half 86 and a moving die half 87. As seen by consideration of FIGS. 17 and 18, casing 84 has a cylindrical peripheral wall 88 and, at one end of wall 88, a transverse wall 89. A number of windows 90*a* to 90*g* are defined by an annular outerpart 89*a* of wall 89, with wall 89 also having an outwardly recessed central part 89*b*, and a bead 89*c* within wall 88 around the junction of parts 89*a* and 89*b*. Also, to one side of the junction between walls 88 and 89, casing 84 has a triangular formation 91 which defines windows 91 *a*. Casing 84 has a wall thickness of about 2.5 mm, while its internal diameter across wall 88 is about 112 mm.

Successive casings 84 were cast on a 380 tonne Idra cold-chamber die casting machine from CA313 alloy. As ladled into the shot sleeve, the alloy was at about 630° C. In die tool 85, alloy flow to the die cavity 85*a* was via a runner 92 and either one or each of the two CEPs 93. The form of the runner/CEP arrangement can be appreciated from the runner/CEP metal shown in FIG. 17, in combination with the sectional detail of FIG. 18. The runner had a cross-sectional area of about 18 mm$^2$. Each CEP 93 had a square inlet end having a cross-sectional area of 17.6 mm$^2$ and an elongate rectangular outlet end having a cross-sectional area of 22.5 mm$^2$. The length of each CEP was 27 mm.

As shown by CEP metal 93*a* in FIG. 17, the two CEPs 93 were closely adjacent and somewhat in parallel. For castings in which only one of the CEPs 93 was used, the other one was blocked off, as represented by the CEP metal 93*a* shown in broken outline in FIG. 17.

The die tool 85 was equipped with thermocouples in the moving die half 87. While several castings were made with either two CEPs or with only one, it was found that the cooling system for tool 85 was inadequate for optimum tool temperature control over repeated casting cycles. To offset this, the machine injection pressure was reduced from the normal setting of 90 MPa to 50 MPa, and the plunger speed was set at 0.575 m/s average velocity with a peak at 0.96 m/s.

At the start of the trials, with the two CEPs 93 used, the die tool temperature was 82° C. The first shot filled the die cavity completely. The second shot produced a cast alternator casing 84 of excellent quality. After some difficulties with ejection of castings, further trials were carried out with only one CEP in use, again with the resultant casings 84 of excellent quality. The trials were aborted after some 30 shots, due to ejection problems, although the trials established that casings 84 of excellent quality were able to be made.

During the trials based on use of two CEPs 93, the CEP inlet flow velocity was 54.8 m/s and the outlet velocity was 42.8 m/s. With trials based on use of one CEP, the CEP inlet flow velocity was 109.6 m/s, and the outlet flow velocity was 85.7 m/s. Thus, in each case, the flow of CA313 alloy through the or each CEP generated required alloy flow, and the microstructure of the castings 84 were of an optimum form as detailed herein. That is, the microstructure was characterised by fine, degenerate primary particles less than 40 μm, such as about 10 μm or less in a matrix of secondary phase. However, due to use of a cold-chamber machine, some larger dendrites up to about 100 μm were present, with these being carried through from the shot sleeve of the die casting machine.

Finally, it is to be understood that various alterations, modifications and/or additions may be introduced into the constructions and arrangements of parts previously described without departing from the spirit or ambit of the invention.

What is claimed is:

1. A process for producing castings of an aluminium alloy, using a pressure casting machine having a pressurised source of substantially molten aluminium alloy and a metal flow system comprising a die or mould assembly defining a die cavity, wherein the process includes the steps of causing the alloy to flow from the source to the die cavity along an alloy flow path defined by a component of the die or mould assembly; causing the alloy, in its flow path along the flow system, to flow through a runner and through an inlet end of a controlled expansion port (CEP); and causing the alloy, in its flow path through the CEP to an outlet end of the CEP, to decrease in flow velocity, whereby the alloy is caused to attain a sufficient flow velocity at the inlet of the CEP, and to undergo a substantial reduction in that flow velocity in its flow through the CEP, such that the alloy attains a viscous or semi-viscous state and retains that state in filling the die cavity, wherein the alloy attains a flow velocity through the CEP inlet which is in excess of 40 m/s and not more than 120 m/s and the alloy flow velocity through the CEP outlet is from 50 to 80% of the alloy flow velocity through the inlet of the CEP.

2. The process of claim 1, wherein the alloy attains a flow velocity through the CEP inlet which is in excess of 50 m/s.

3. The process of claim 1, wherein the alloy attains a flow velocity through the CEP inlet of from 80 to 120 m/s.

4. The process of claim 1, wherein the alloy flow velocity through the CEP outlet is from 65 to 75% of the flow velocity of the alloy through the inlet of the CEP.

5. The process of claim 1, wherein the alloy flow velocity through the CEP outlet is in excess of 20 m/s.

6. The process of claim 1, wherein the alloy flow velocity through the CEP outlet is in excess of 25 m/s.

7. The process of claim 1, wherein the alloy flow velocity through the CEP outlet is from 40 to 95 m/s.

8. The process of claim 1, wherein the alloy flows from the outlet of the CEP directly into the die cavity.

9. The process of claim 1, wherein at least part of the length of the CEP is defined by a region of the die cavity.

10. The process of claim 1, wherein the runner is a first runner, and wherein the alloy flow from the outlet of the CEP to the die cavity is through a second runner which defines a section of the alloy flow path between the outlet of the CEP and the die cavity.

11. The process of claim 1, wherein the alloy is caused to flow through at least two CEPs, and each CEP has an inlet through which aluminium alloy is received from a respective runner.

12. The process of claim 11, wherein each runner and the respective CEP provides alloy flow to a respective one of at least two die cavities defined by the die or mould assembly.

13. The process of claim 11, wherein each runner is a first runner for the respective CEP, and wherein the flow system further includes at least two second runners each of which defines a respective section of the alloy flow path between the outlet of a respective CEP and a respective die cavity.

14. The process of claim 1, wherein turbulence is generated in the flow of alloy to the CEP.

15. The process of claim 1, wherein the alloy flowing through the CEP attains a semi-solid state in which it possesses thixotropic properties and said semi-solid states is retained in filling the die cavity.

16. The flow system of claim 15, wherein solidification of alloy in the die cavity is sufficiently rapid to attain a microstructure in a resultant casting characterised by fine degenerate dendrite primary particles less than 40 μm in a matrix of secondary phase, and solidification of the alloy back into the CEP, such that the alloy in the CEP in axial sections is characterised by striations or bands extending transversely with respect to alloy flow through the CEP.

* * * * *